US010359166B2

(12) United States Patent
Kratochvil et al.

(10) Patent No.: US 10,359,166 B2
(45) Date of Patent: Jul. 23, 2019

(54) LIGHT DEVICE, ESPECIALLY A HEADLIGHT FOR MOTOR VEHICLES

(71) Applicant: Varroc Lighting Systems, s.r.o., Senov u Noveho Jicina (CZ)

(72) Inventors: Jan Kratochvil, Trebic (CZ); Ondrej Hasa, Ratibor (CZ); Jan Grof, Libhost (CZ); Milos Macicek, Novy Jicin (CZ); Radek Orlita, Novy Jicin (CZ)

(73) Assignee: Varroc Lighting Systems, S.R.O., Senov U Noveho (CZ)

( * ) Notice: Subject to any disclaimer, the term of this patent is extended or adjusted under 35 U.S.C. 154(b) by 170 days.

(21) Appl. No.: 15/220,229

(22) Filed: Jul. 26, 2016

(65) Prior Publication Data

US 2017/0030545 A1 Feb. 2, 2017

(30) Foreign Application Priority Data

Jul. 30, 2015 (CZ) ..... PV 2015-531

(51) Int. Cl.
*F21S 8/10* (2006.01)
*F21S 41/147* (2018.01)
(Continued)

(52) U.S. Cl.
CPC ..... *F21S 41/147* (2018.01); *F21S 41/255* (2018.01); *F21S 41/295* (2018.01); *F21S 41/657* (2018.01);
(Continued)

(58) Field of Classification Search
CPC ..... F21S 48/1159; F21S 48/1742; F21S 48/1258; F21S 41/255; F21S 41/657
See application file for complete search history.

(56) References Cited

U.S. PATENT DOCUMENTS 7,329,033 B2 2/2008 Glovatsky et al.
9,797,569 B2 10/2017 Kratochvil et al.
(Continued)

FOREIGN PATENT DOCUMENTS

CZ 301707 B6 6/2010
DE 102006008193 A1 8/2007
(Continued)

OTHER PUBLICATIONS

Search Report dated Oct. 30, 2015 by the Industrial Property Office of the Czech Republic in Corresponding Application PV 2015-531, with English translation (7 pages).
(Continued)

*Primary Examiner* — Joseph L Williams
*Assistant Examiner* — Jacob R Stern
(74) *Attorney, Agent, or Firm* — Hovey Williams LLP

(57) ABSTRACT

A light device, especially a headlight for motor vehicles, comprises a holding bushing (1), covered by a translucent cover (2), and an inner chamber (3) having mounted there in an optical system (5) for generation of light rays and enabling of controlled selective changes of a light trace on a projection surface. The optical system includes a lens (51) and a light assembly (52) comprising at least one light source and a carrier to carry the light source. The lens is arranged in a fixed position with respect to the position of the translucent cover, and the position of the light assembly is selectively adjustable in a controlled way with respect to the position of the lens by movement of the light assembly in direction (A) and/or by movement in direction (B), wherein the directions (A) and (B) are substantially perpendicular to direction of optical axis (C) of the lens.

15 Claims, 12 Drawing Sheets

Figure 1:
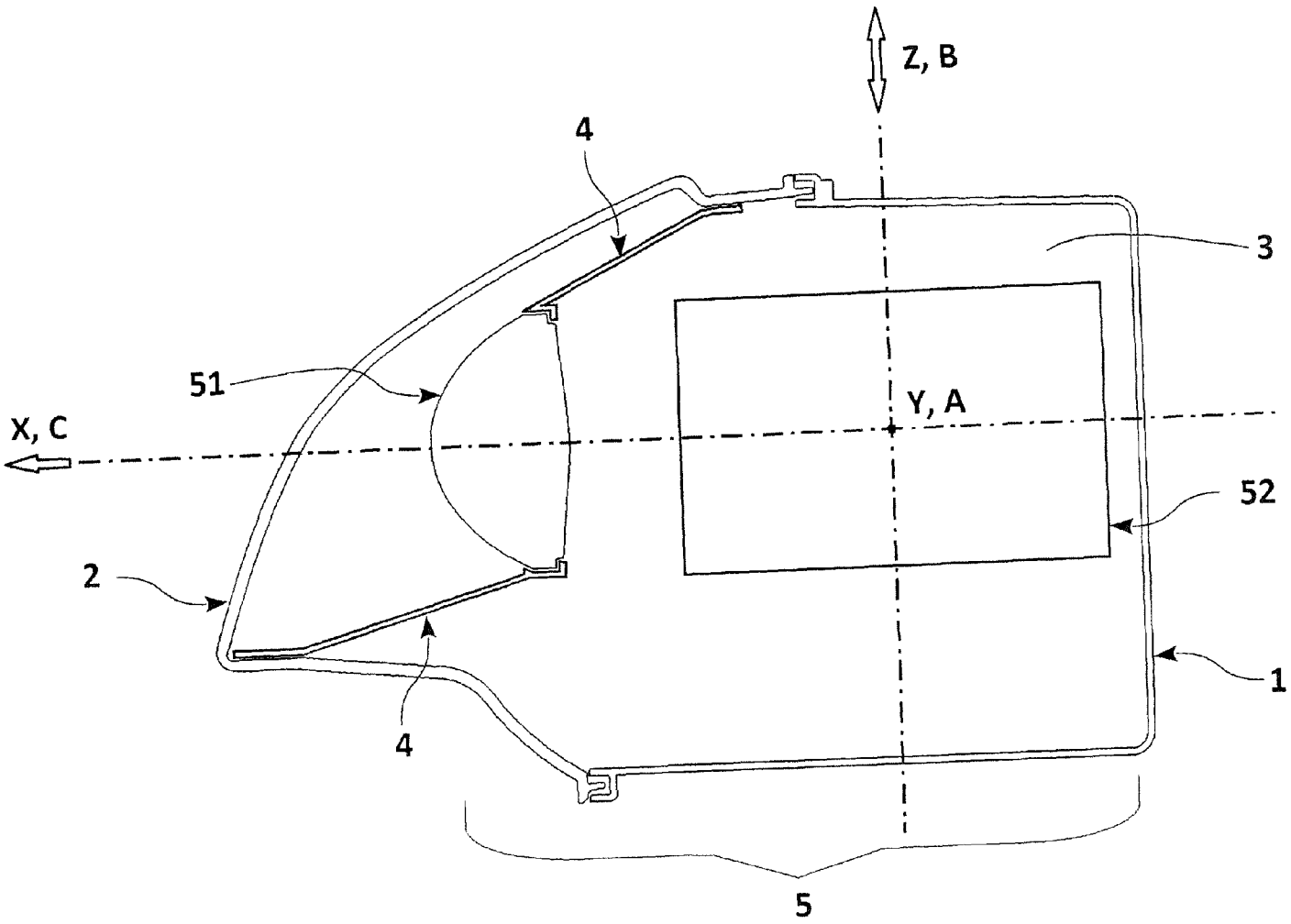

(51) Int. Cl.

| | |
|---|---|
| ***F21S 41/29*** | (2018.01) |
| ***F21S 41/255*** | (2018.01) |
| ***F21S 41/657*** | (2018.01) |
| ***F21S 41/683*** | (2018.01) |
| ***F21S 45/47*** | (2018.01) |
| ***F21S 45/48*** | (2018.01) |

(52) U.S. Cl.
CPC ..... *F21S 41/683* (2018.01); *F21S 45/47* (2018.01); *F21S 45/48* (2018.01)

(56) References Cited

U.S. PATENT DOCUMENTS

| | | | | |
|---|---|---|---|---|
| 2007/0091632 | A1* | 4/2007 | Glovatsky ..... | B60Q 1/0052 362/547 |
| 2009/0046474 | A1* | 2/2009 | Sato ..... | B60Q 1/076 362/466 |
| 2013/0107552 | A1 | 5/2013 | Ahn et al. | |
| 2013/0215635 | A1 | 8/2013 | Boyd, Jr. et al. | |
| 2016/0169497 | A1 | 6/2016 | Kratochvil et al. | |

FOREIGN PATENT DOCUMENTS

| | | | |
|---|---|---|---|
| DE | 102006020961 | A1 | 11/2007 |
| DE | 102007006258 | A1 | 8/2008 |
| DE | 102007053399 | A1 | 5/2009 |
| DE | 102008061526 | A1 | 6/2010 |
| DE | 102010054922 | A1 | 6/2012 |
| DE | 102012107033 | A1 | 5/2013 |
| DE | 102012103631 | A1 | 10/2013 |
| DE | 102015121819 | A1 | 6/2016 |
| EP | 2532951 | A1 | 12/2012 |
| FR | 2760069 | A1 | 8/1998 |
| FR | 2807982 | A1 | 10/2001 |
| FR | 2838809 | A1 | 10/2003 |
| KR | 20110030194 | A | 3/2011 |
| WO | 2005116522 | A1 | 12/2015 |

OTHER PUBLICATIONS

Office Action dated Apr. 3, 2017 in related German Application No. 10 2016 113 966.1, with machine English translation (9 pages).

* cited by examiner

LIGHT DEVICE, ESPECIALLY A HEADLIGHT FOR MOTOR VEHICLES

FIELD OF THE INVENTION

The invention relates to a light device, especially a headlight for motor vehicles. Thus, the invention belongs to the field of the design of headlights, especially of motor vehicles, and relates to a light device including a light-emitting optical system that is selectively adjustable to achieve the desired light radiating characteristic.

BACKGROUND INFORMATION

A headlight, especially for motor vehicles, contains at least one optical system comprising a powerful light source and optical elements. The light source emits light rays and the optical elements represent a system of refractive and reflective surfaces, interfaces of optical environments and diaphragms that influence the direction of light rays within the creation of the output light trace.

The optical system of the headlight is mounted in a shaped holding bushing of the headlight. To ensure the desired function of the headlight, precise adjustment of the optical system is necessary, i.e. setting of the position of the light source with respect to all the optical elements. The optical system and its individual elements are first adjusted during the production of the headlights, when the setting of individual components depends on various design and assembly factors. The entire adjustment of the optical system is subsequently done by means of adjustment elements of various designs, which must be accessible from the outer side of the headlight. The optical system is mostly adjustable on two axes by means of a mechanical and/or electric adjustment system.

In the prior art, a number of adjustment systems are known allowing adjustment of the optical system in the horizontal and vertical direction to compensate any assembly deviations of the vehicle body and variable operational loading of the vehicle. The adjustment system of the optical system is most frequently implemented through three-point mounting while one point is generally fixed and two points are sliding, generally consisting of ball or cylindrical mounting. These three assembly points then make it possible to adjust the light unit in the horizontal and vertical position within the headlight.

E.g., the documents DE102006008193A1, FR2760069A1, FR2838809A1, and FR2807982A1 describe various designs of the adjustment system to achieve the desired characteristic of the optical system of the projection unit. A disadvantage of these designs is the fact that around the output lens of the projection unit there must be a free space to ensure adjustment of the optical system and free movement of the output lens. Each of the headlights emits light to a certain delimited space which is manifested in such a way there is a different free space between the fixed part of the headlight as the covering mask or holding bushing and the movable output lens. Then, from the front view the output lenses are not situated in parallel, but one lens deviates from the parallel direction of the other one. From the point of view of style, output lenses situated in a non-parallel direction represent a disturbing design element where the output lenses either converge or diverge.

The document CZ301707 discloses an adaptive system of headlights of motor vehicles with a projector unit that is vertically and horizontally adjustable by means of actuators for vertical and horizontal movement. The projector unit has a diaphragm in a frame, consisting of two movable segments, where the segments of the diaphragm are controllable by the actuators, while a diaphragm segment is fixed with respect to the diaphragm frame, and the entire projector unit can be moved vertically by means of an actuator with respect to the holding bushing and covering glass.

In modern headlights of motor vehicles, light sources consisting of LED light units are frequently used. An advantage of LED light units is their durability, small dimensions and the possibility of horizontal arrangement in systems perpendicular to the light axis of the headlight, in vertical and horizontal rows. During a drive of the motor vehicle, with the high beam on, individual light units or their groups or rows can be optionally switched off to produce a dark unlit part in the light pattern on the carriageway in the place where a camera mounted on the vehicle detects an oncoming vehicle. However, LED light units individually have a low light output, which can be increased by using a high number of LED light sources, but directing light beams from a higher number of LED light sources and creating a suitable light pattern is difficult and thus it still remains a technical problem.

In the operation condition, the light source arranged in a headlight emits a great amount of heat, which heats up the bushing and the cover of the headlight, as well as all parts that are found in the inner space of the headlight. The inner space of the headlight is further heated up by heat transfer from the other components of the engine compartment of the vehicle. Parts of a headlight, especially a motor vehicle headlight, get regularly heated up during vehicle operation and after deactivation of the light source they cool down, which causes undesired internal stress in the parts. A high temperature in the internal space of the headlight also has a negative impact on the luminous intensity of light sources.

The document U.S. Pat. No. 7,329,033B2 discloses a cooling design when the inner space of the headlight is connected to the external ambient environment and during air exchange hot air from the inner space of the headlight is exchanged with cold air from the external environment. However, unwanted dirt and dust penetrate into the inner space of the headlight through every opening in the bushing.

The document CZ2014-919 discloses the design of sliding or rotary mounting of a part of a cooling channel with a cooling element in the inner chamber, allowing subsequent adjustment of the position of the light source to achieve the desired radiation characteristic while the cooling channel is closed, and no undesired contamination of the cooling system occurs. A disadvantage of this solution is sliding and/or rotary mounting around two divergent or skew axes, and the adjustment system is thus geometrically sensitive to setup of the light units in space. If the adjustment system allows movement of the light unit only in the vertical or only in the horizontal direction, the setup of the light unit in space is less sensitive and simpler from the design point of view.

A goal of the invention is to eliminate the above mentioned shortcomings of the prior art. Another goal is to design a light system the adjustment system of which for achievement of the desired radiation characteristic is structurally simple and at the same time enables efficient adjustment of the optical system.

PRINCIPLE OF THE INVENTION

The above mentioned goals of the invention are met by a light device, especially a headlight for motor vehicles according to the present invention, comprising a holding bushing, covered by a translucent cover, and an inner chamber where an optical system for generation of light rays and enabling of controlled selective changes of a light trace on a projection surface, especially carriageway, is mounted. The optical system includes a lens and a light assembly comprising at least one light source and a carrier to carry the light source. The lens is arranged in a fixed manner with respect to the translucent cover and the position of the light assembly is selectively adjustable in a controlled manner with respect to the position of the lens by selective movement in a first direction and/or by selective movement in a second direction, wherein the first direction and the second direction are substantially perpendicular to the direction of optical axis of the lens.

According to one of the embodiments, the light assembly comprises a cooler for dissipation of heat generated by the light source.

According to another one of the embodiments, the first direction makes an acute angle with the second direction.

According to another one of the embodiments, the first direction is substantially perpendicular to the second direction.

The light device preferably a first drive means to control the movement of the light system in the first direction, and a second drive means to control the movement of the light system in the second direction.

According to one of the embodiments, the light assembly comprises a first actuator to which the carrier carrying at least one light source is connected, wherein the first actuator is connected to the first drive means for controlled selective movement of the first actuator in the first direction. The light assembly also comprises a second actuator connected to the second drive means for controlled selective movement of the second actuator in the second direction. The first actuator is connected to the second actuator in such a way that movement of the second actuator in the said second direction by a certain distance simultaneously causes movement of the first actuator in the same second direction by the same distance.

The connection of the first actuator to the second actuator can be implemented in such a manner that the second actuator is fitted with a supporting part, on which or in which the first actuator is mounted in a selectively slidable manner. The supporting part may be preferably a hollow body, e.g. a hollow tube the longitudinal axis of which lies in the first direction. In this hollow body, the first actuator is mounted with the possibility of sliding movement of the first actuator in the first direction.

According to one of the embodiments, the first actuator has a cylindrical part at its end, fitted with a male thread for engagement with the first drive means, the first drive means comprising a toothed wheel fitted with an inner hole with an inner profile engaging with the male thread, and a worm gear having a worm for engagement with the teeth of the toothed wheel, so that the selective rotation of the worm is converted to a linear sliding movement of the first actuator in the first direction.

According to another one of the embodiments, the second actuator has a cylindrical part at its end, fitted with a male thread for engagement with the second drive means, the second drive means comprising a toothed wheel fitted with an inner hole with an inner profile engaging with the male thread, and a worm gear having a worm for engagement with the teeth of the toothed wheel, so that the selective rotation of the worm is converted to a linear sliding movement of the second actuator in the said second direction.

According to one of the embodiments, the first actuator comprises a cooling channel for flow of cooling media where cooling fins of the cooler are situated.

The cooler advantageously comprises at least one cooling element, located between the carrier of the at least one light source and the cooling fins, for heat dissipation into the cooling fins.

According to one of the embodiments, the light assembly comprises a reflector for reflecting light generated by the light source towards the lens.

According to one of the embodiments, the light assembly comprises a plurality of light sources carried by at least one carrier and arranged on a plane that is substantially perpendicular to the optical axis of the lens.

The light device advantageously comprises at least one diaphragm situated between the lens and the light source.

It is convenient if the position of the diaphragm can be selectively adjusted in a controlled manner independently of the movement of the light assembly.

The diaphragm may be part of the light assembly having its position adjustable in a controlled manner, but in another embodiment it need not be part of the light assembly having its position adjustable in a controlled manner.

OVERVIEW OF FIGURES IN THE DRAWINGS

Figure 2:
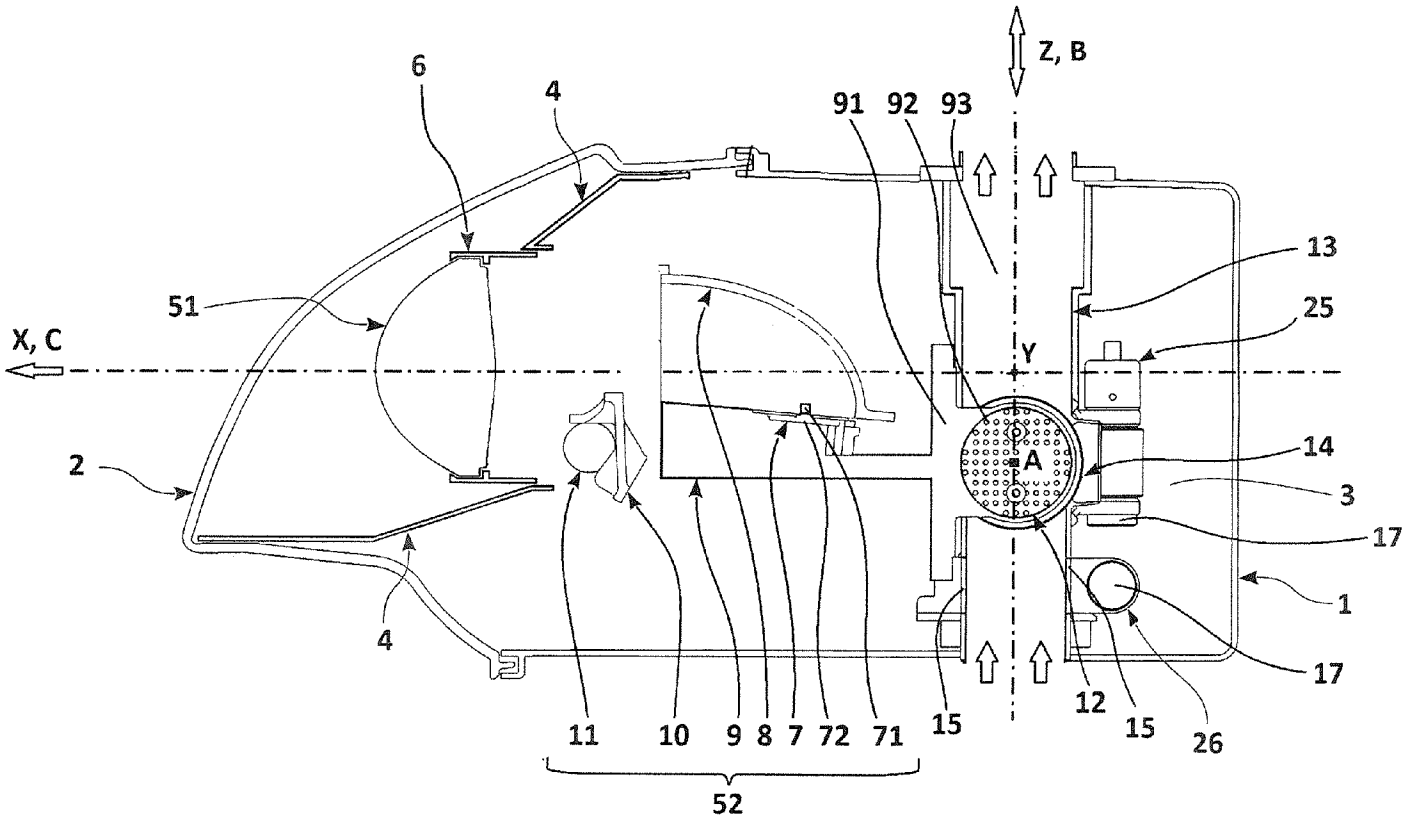
Figure 3:
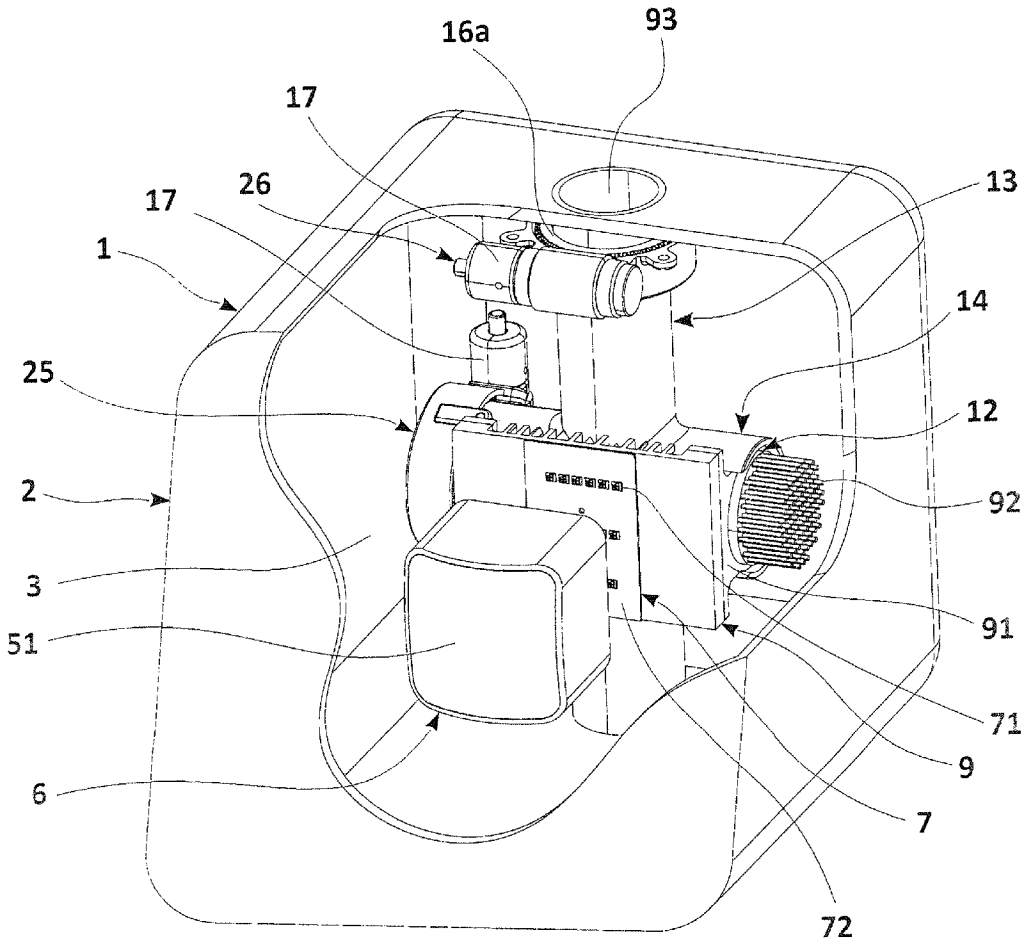
Figure 4:
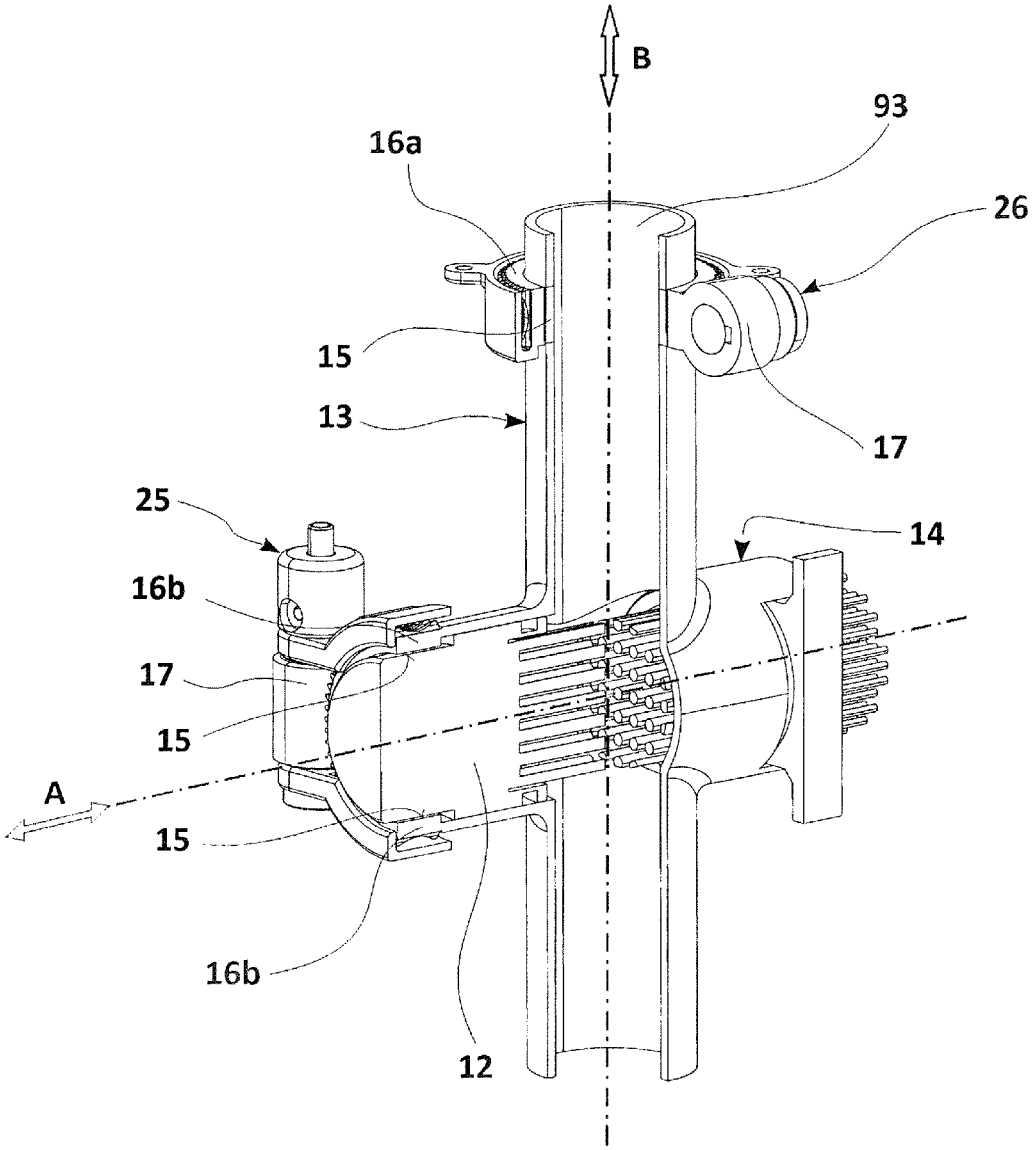
Figure 5:
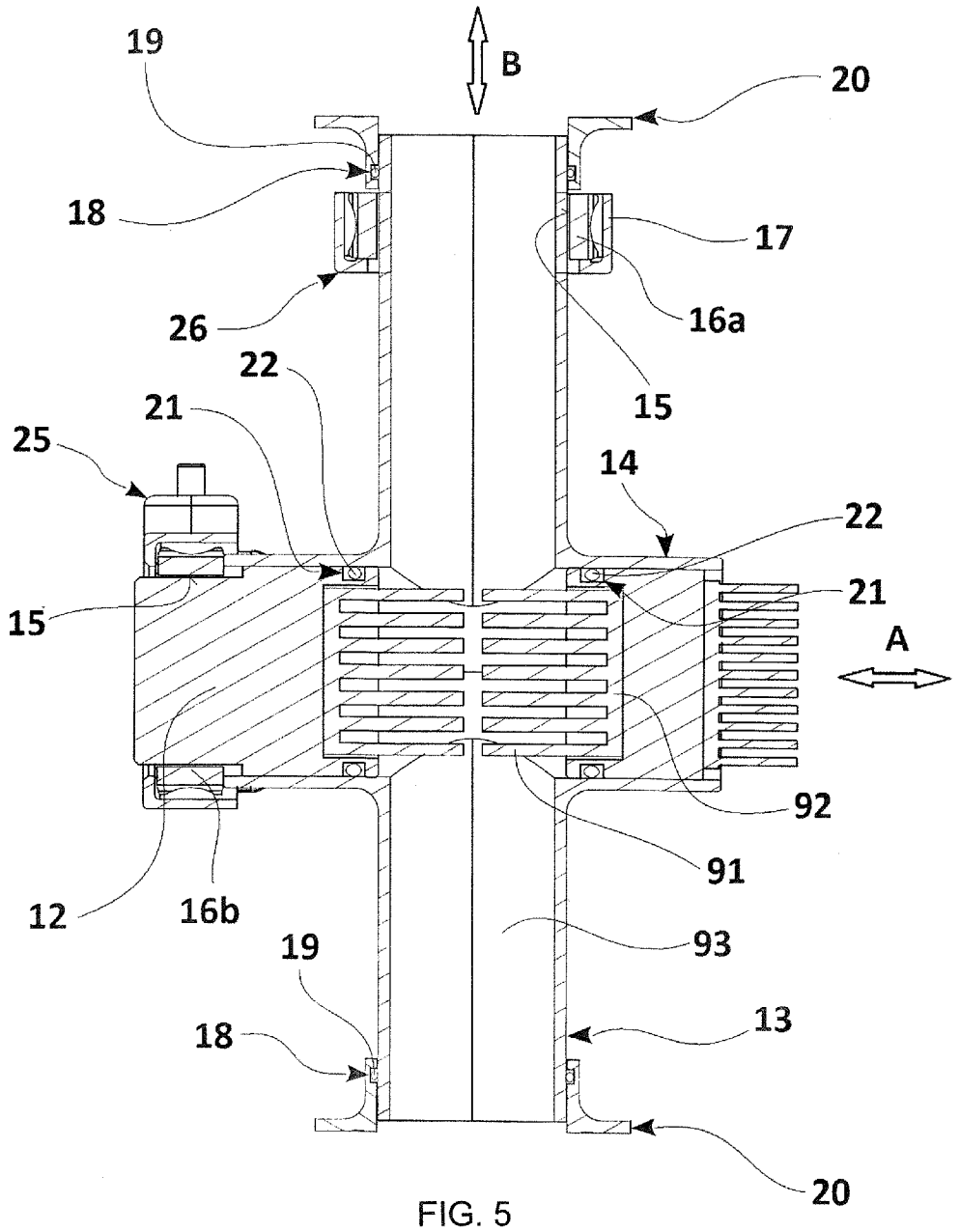
Figure 6:
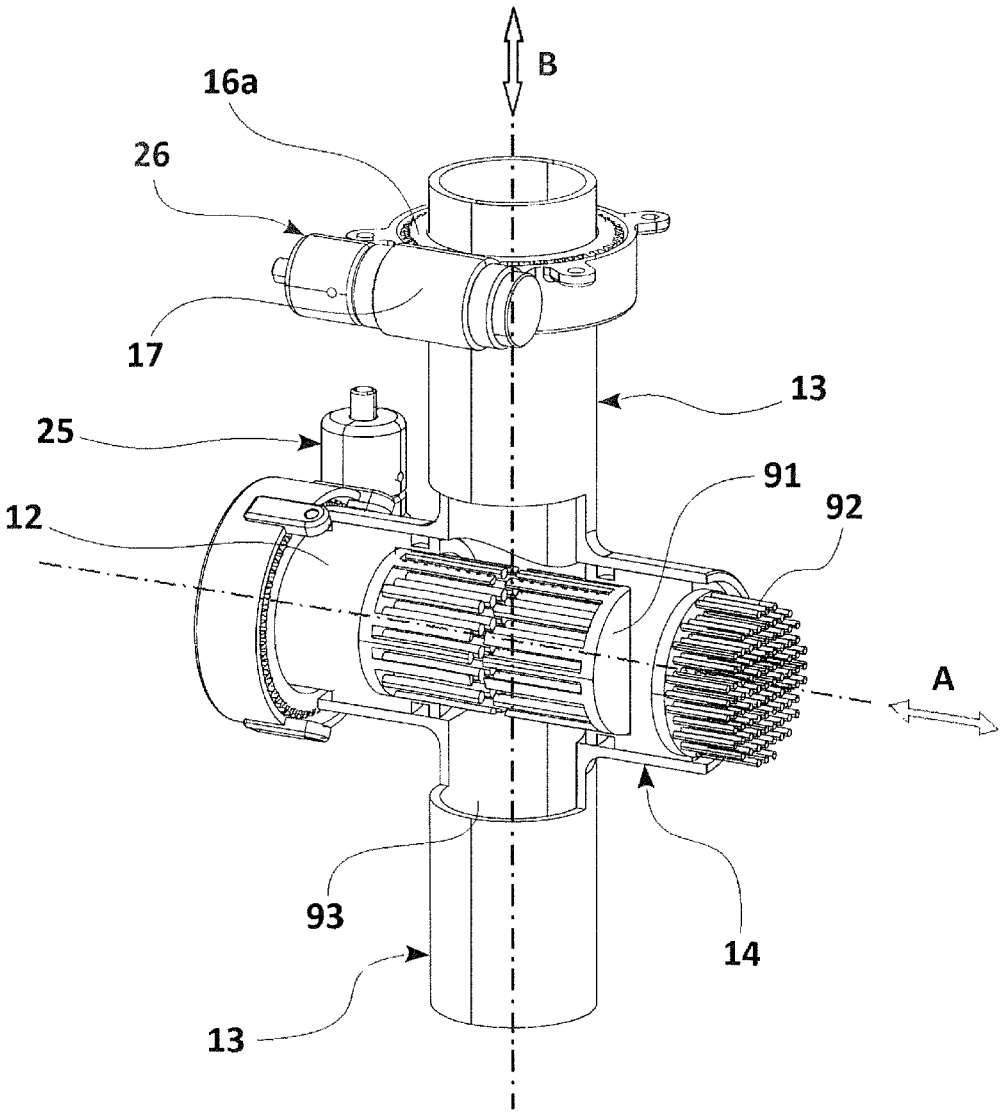
Figure 8A:
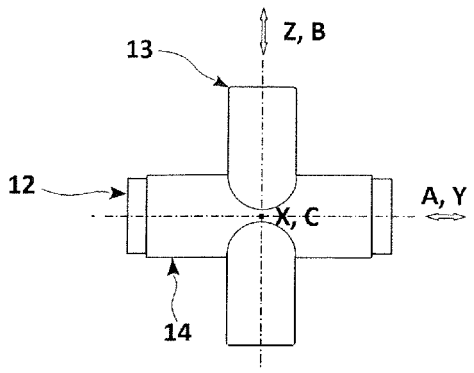
Figure 8B:
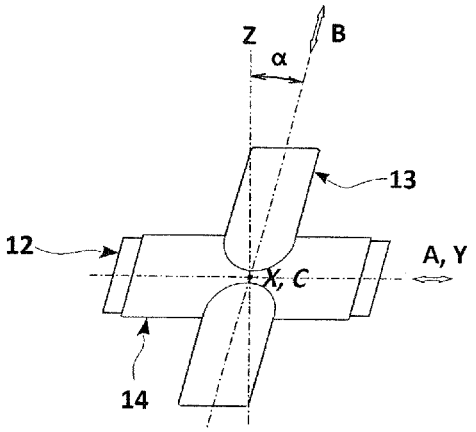
Figure 8C:
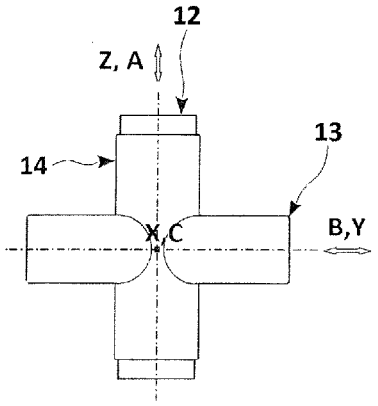
Figure 8D:
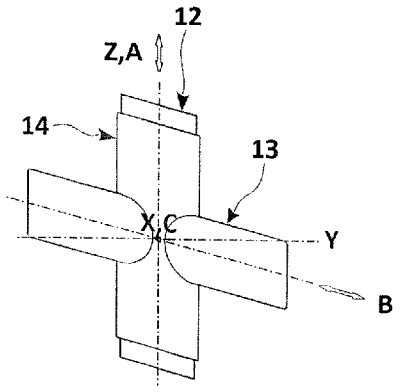
Figure 9A:
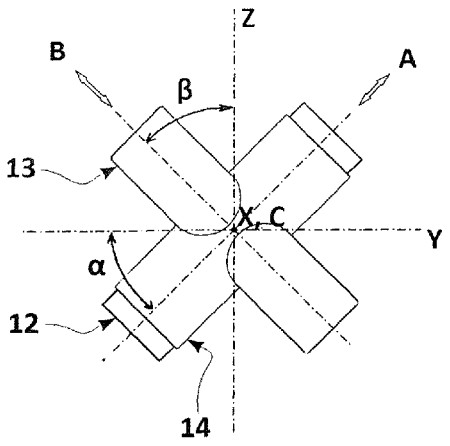
Figure 9B:
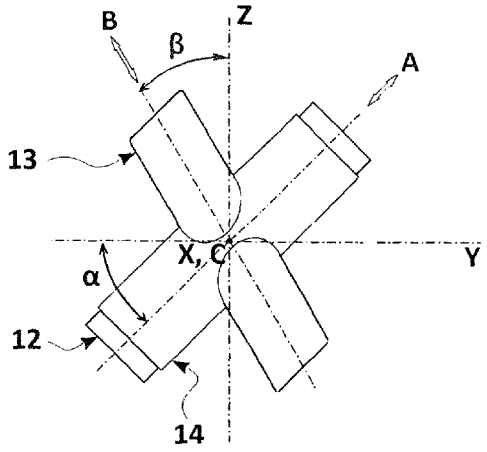
Figure 9C:
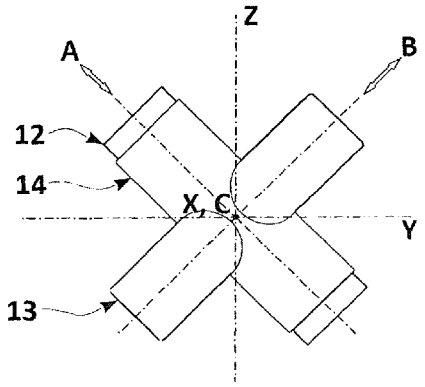
Figure 9D:
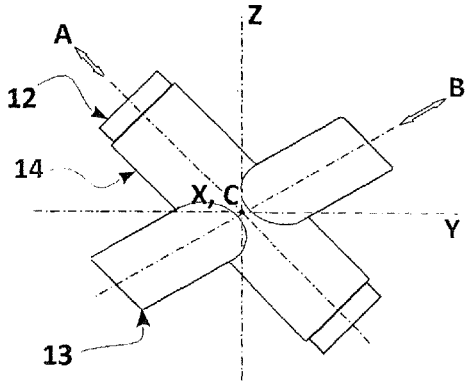
Figure 10:
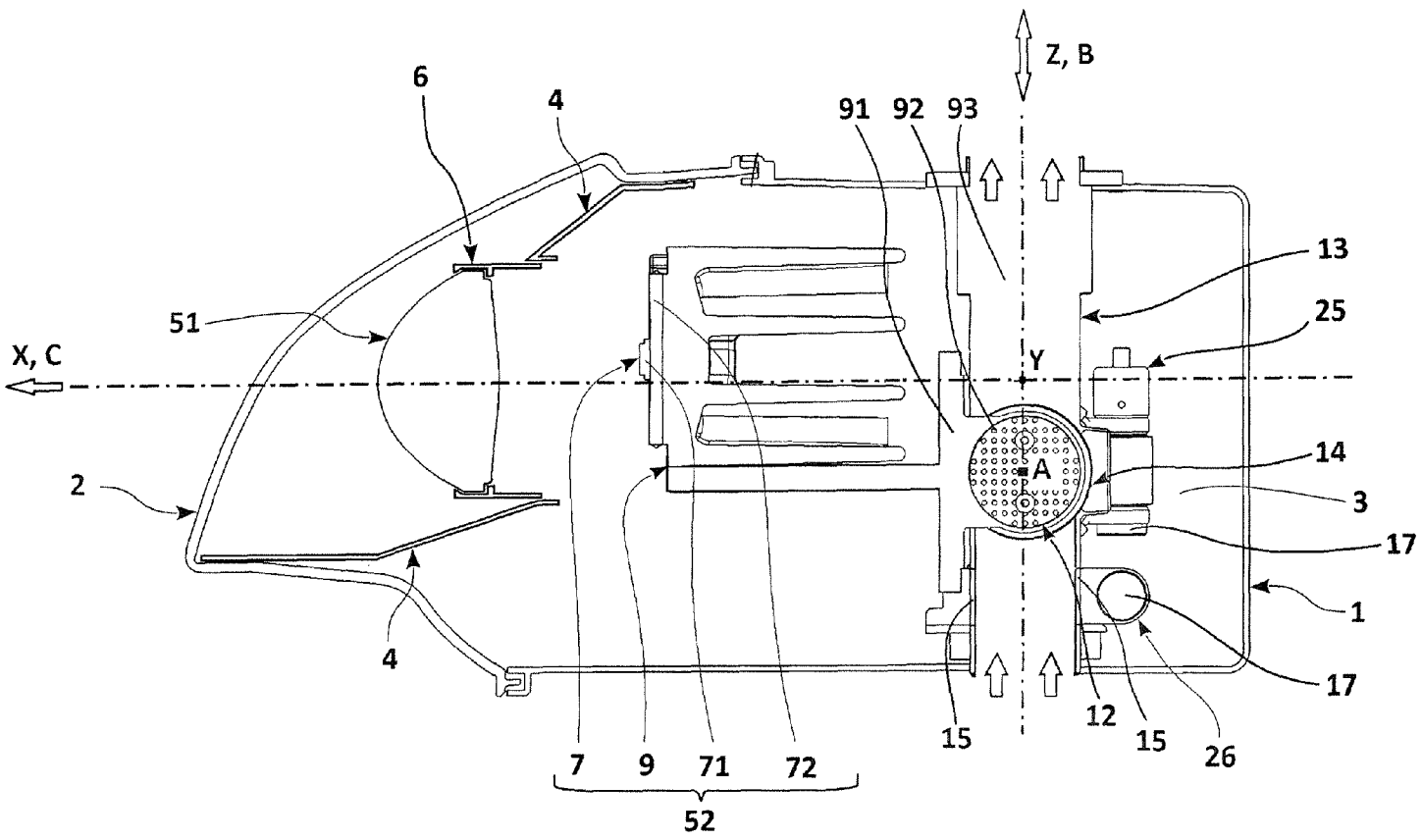
Figure 11:
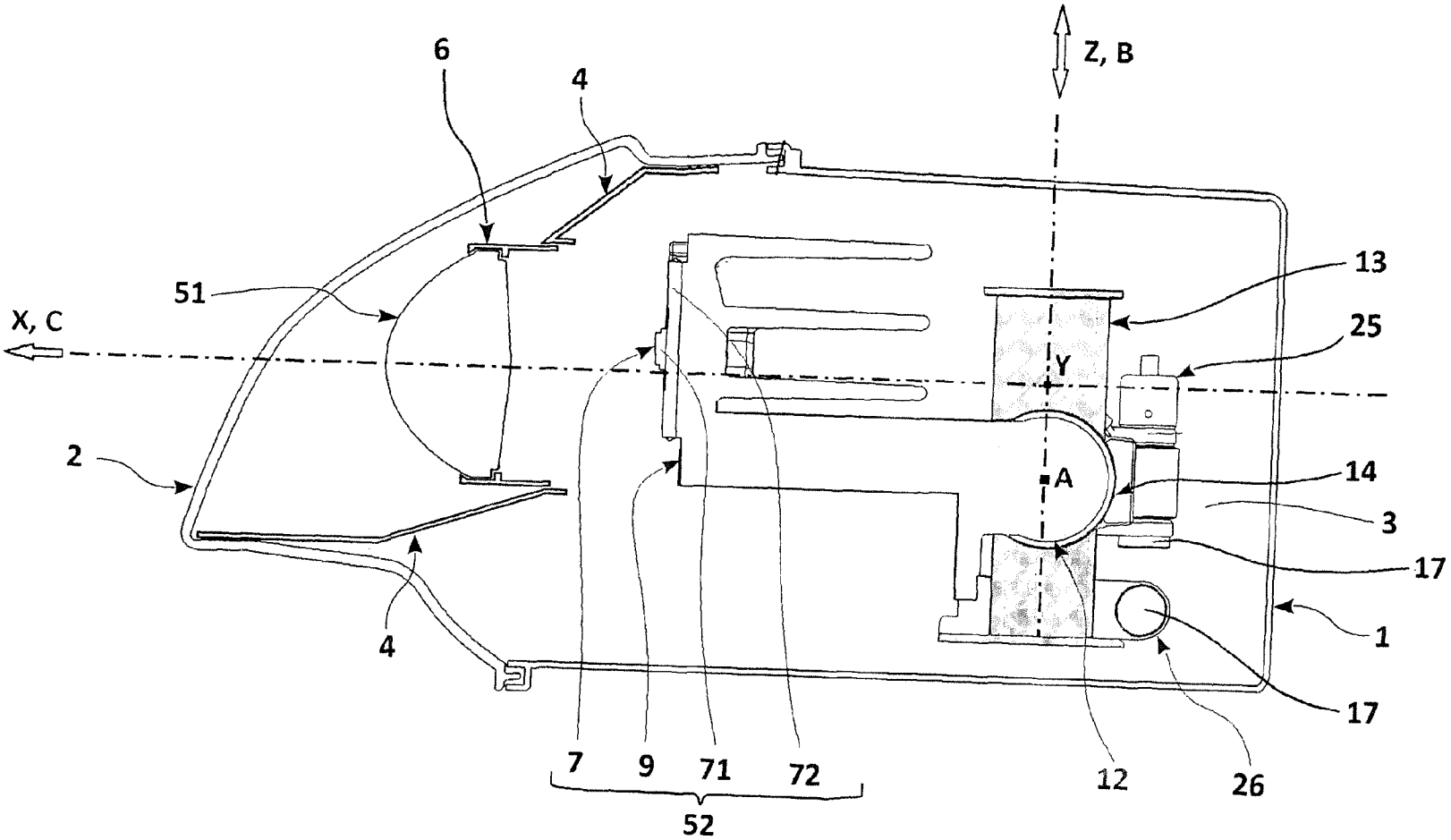
Figure 12:
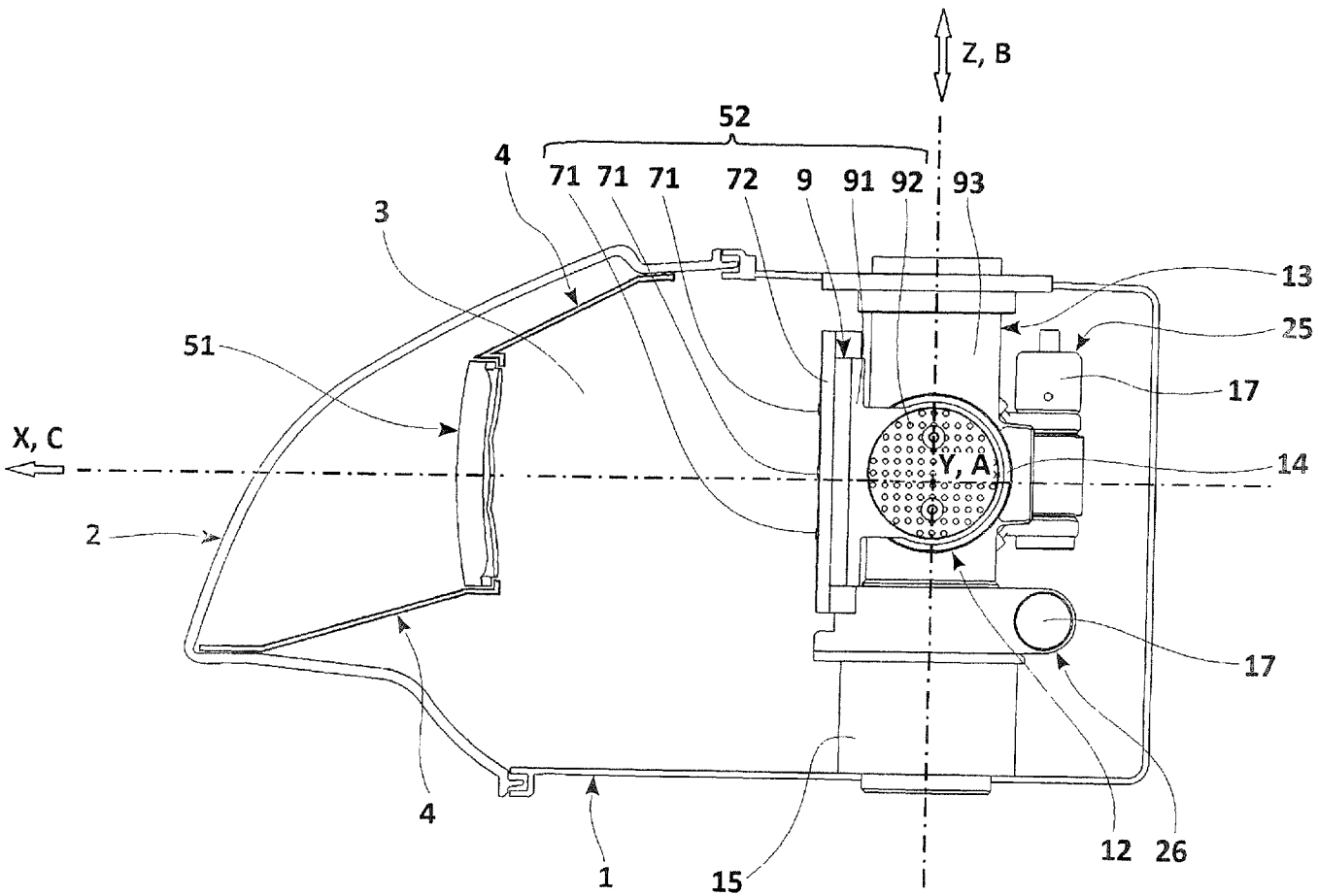

The invention will be clarified in a more detailed manner with the use of its embodiment examples with references to attached drawings, where:

FIG. 1 shows a vertical cross-section through the light device with a covering mask, FIG. 2 shows a vertical cross-section through one of the embodiments of the light device of the projector type, FIG. 3 shows the internal arrangement of another one of the embodiments of the light device in a perspective view and within the bushing and cover, a portion of which is broken away, FIG. 4 shows a perspective detail of the internal arrangement of the actuators of the light device of FIG. 3, in a partial cross-section, FIG. 5 shows a vertical cross-section through the actuators and cooler of the light device of FIG. 3, FIG. 6 shows a detail of the internal arrangement of the actuators of the light device of FIG. 3 in a perspective view, with a partial cross-section, and with a portion of the housings of the actuators broken away, FIGS. 7*a* through 7*d* show examples of embodiments of the arrangement of the sliding mechanisms in the walls of the actuators, FIGS. 8*a*, 8*b*, 8*c*, 8*d*, 9*a*, 9*b*, 9*c* and 9*d* show the arrangement of the actuators with regard to the horizontal and vertical direction, FIG. 10 shows a vertical cross-section through another one of the embodiments of the light device of the projector type, FIG. 11 shows a vertical cross-section through another one of the embodiments of the light device of the projector type, and FIG. 12 shows a vertical cross-section through another one of the embodiments of the light device.

EXAMPLES OF EMBODIMENTS

With reference to FIG. 1, the light device includes a holding bushing 1, covered by a translucent cover 2, and the inner chamber 3 of the headlight where the covering mask 4 and the optical system 5 are mounted. The optical system 5 comprises a static lens 51 and a movable light assembly 52. The static lens 51 is fixed with respect to the position of the holding bushing 1, translucent cover 2 and covering mask 4. On the other hand, the position of the light assembly 52 is selectively adjustable in the direction A and in the direction B.

For the purposes of this invention and the whole description and patent claims, by a movement in the direction A or the direction B is meant a movement along any line having the direction A or the direction B, respectively, and the movement covers both movement forward and movement backward, i.e. both "orientations", so that "direction A" or "direction B" covers both orientations (forward and backward). Both the directions A and B are perpendicular or substantially perpendicular to the direction of optical axis C of the lens 51, and the directions A and B can make a right, acute or obtuse angle together (e.g. in the embodiment of FIG. 1 the directions A and B make the right angle).

FIG. 2 shows an embodiment of the light device where the static lens 51 of the optical system 5 is set up in the inner chamber 3 of the headlight by means of the holder 6, the position of which is invariable with respect to the position of the holding bushing 1, translucent cover 2 and covering mask 4. In this particular case the light assembly 52 comprises a light unit 7 including a light source 71 and carrier 72, reflector 8, cooler 9 and diaphragm 10, wherein the diaphragm 10 is, through a sliding, rotary or sliding mechanism 11, further independently and selectively movable with respect to the other optical elements 7, 8, 9 of the light assembly 52. In this embodiment, the directions B and C lie on the axes Z and X of a Cartesian rectangular system and the direction A is parallel to the axis Y of the Cartesian system, (the direction A naturally merges with the axis Y if the second actuator 13 is respectively shifted in the direction B). However, the directions A, B and the optical axis C may also be generally situated in the Cartesian system in another way, which will be explained below.

FIG. 3 shows another possible embodiment where the light assembly 52 includes a light source 71, carrier 72 and cooler 9 as well as the first actuator 12 and the second actuator 13.

FIGS. 2 to 6 use the reference mark 25 to refer to the first drive means 25 for the control of the movement of the light assembly 52 in the direction A and the reference mark 26 to refer to the second drive means 26 for the control of the movement of the light assembly 52 in the direction B. The drive means 25, 26 can be realized with a number of drive mechanisms some examples of which will be mentioned in more detail below. Although the next examples show the application of always the same drive mechanism for the drive means 25 as well as 26, it is obvious that the drive means 25, 26 can use mutually different drive mechanisms.

The first actuator 12 and the second actuator 13, enabling independent movement in the direction A and in the direction B, are shown in FIGS. 4, 5 and 6. The second actuator in the particular embodiment example is fitted with a hollow body 14 that the first actuator 12 is mounted in in a selectively slidable manner. The first actuator 12 and the second actuator 13 are fitted at one of their ends with a male thread 15, there being an adjacent toothed wheel 16*a*, 16*b* with a corresponding profile, adapted for torque transfer between the worm gear 17 and the linearly moving actuator 12 and 13. In the inner space of the first actuator 12 the cooling elements 91 of the cooler 9 are situated. In the embodiment shown in FIG. 5, in the second actuator 13 a through cooling channel 93 is provided for cooling media flow, which the cooling fins 92 of the cooler 9 protrude into. The first actuator 12 is fitted on its perimeter with two recesses 21 and O-rings 22 seated in them in such a manner as to prevent leaking of the cooling media from the cooling channel 93 between the outer surface of the first actuator 12 and the inner surface of the hollow body 14, and at the same time to support the slidable mounting between these surfaces. The actuator 13 is, at its outwardly oriented ends, seated in anchoring elements 20 that are fitted with recesses along their perimeter 18, where O-rings 19 are seated for sliding mounting of the actuator 13 in the anchoring elements 20.

The first actuator 12 moves in a selectively slidable manner in the hollow body 14, e.g. a tube, which the second actuator 13 is fitted with. During this selective sliding movement, the cooling element 91 of the cooler 9 is carried to the left or to the right. Rotation of the toothed wheel 16*a* around the axis that is parallel to the direction B, which is, in the embodiment shown in FIGS. 4 to 6, equal to the vertical axis Z of the rectangular Cartesian coordinate system, causes movement of the second actuator 13 along the direction B. Rotation of the toothed wheel 16*b* around the axis that is parallel to the direction A, which is, in the embodiment shown in FIGS. 4 to 6, equal to the horizontal axis Y of the rectangular Cartesian system, enables movement of the first actuator 12 in the direction A. Thus, the position of the cooler 9, to which at least one light unit 7 is attached, can be selectively adjusted to create the required light trace on the projection surface or carriageway.

Figure 7A:
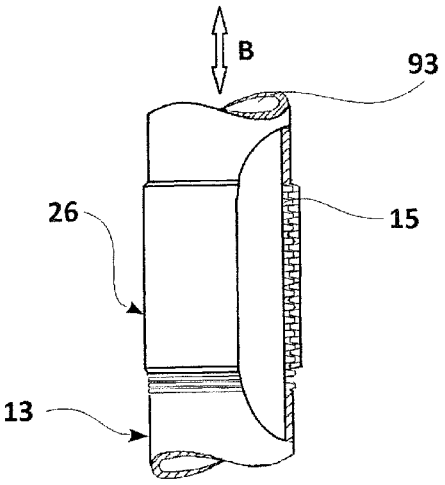
Figure 7B:
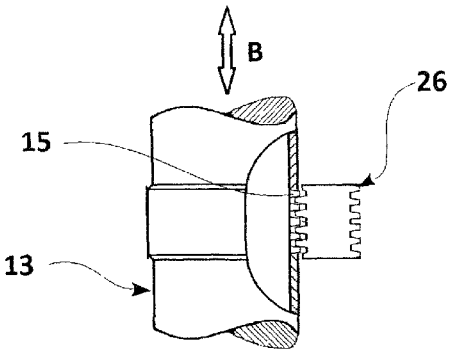
Figure 7C:
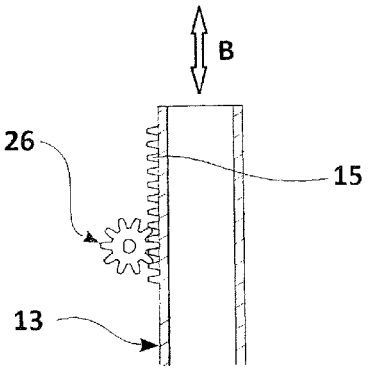
Figure 7D:
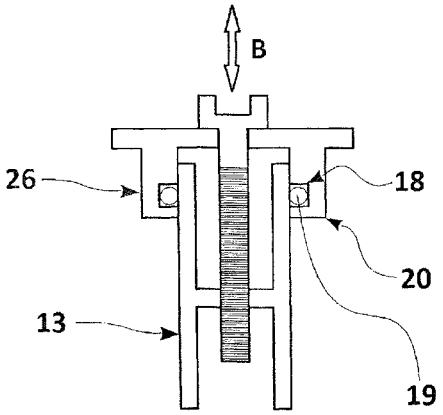

The drive means 25 and 26 are supplied with their own drive energy e.g. (not shown in the drawings) servo motors, electric motors or various other known drives, while for the transformation of the drive force to the sliding movement of the actuator 12 and 13, a number of drive mechanisms can be employed as documented by the examples shown in FIGS. 7*a* to 7*d*, where FIG. 7*a* schematically shows a drive mechanism based on a threaded tube, FIG. 7*b* depicts a threaded rod, FIG. 7*c* depicts a toothed rack, and FIG. 7*d* depicts a central screw.

FIGS. 8*a*-8*d* and 9*a*-9*d* are presented to schematically show various examples of possible mutual positions of the directions A and B with respect to the axes Y and Z, therefore the first actuator 12 and the second actuator 13 are only shown in a very simplified way. One of the options is that the directions A, B and the optical axis C lie on the axes Y, Z and X of a rectangular Cartesian coordinate system where the axes Y and X can lie on the horizontal plane and the axis Z is vertical. This situation is schematically shown in FIG. 8*a*. In other embodiments that are applicable in practice, the mutual arrangement of the directions A, B and optical axis C may however be different—options of such arrangements implementable in practice are shown in FIGS. 8*b*, 8*c*, 8*d*, 9*a*, 9*b*, 9*c* and 9*d*. E.g. in the arrangement shown in FIG. 8*b* the direction B deflects from the axis Z by the angle $\alpha$, or both the directions A, B may deflect from the respective axes Y and Z by the angles $\alpha$,$\beta$, which may be both the same (see FIG. 9*a*) and different (FIG. 9*b*). If the angles $\alpha$ and $\beta$, are the same and if they amount to 90°, the direction A (and thus the first actuator 12) will lie on the axis Z and the direction B on the axis Y—this embodiment is shown in FIG. 8*c*. If the angles $\alpha$ and $\beta$ are different, it means at the same time that the invention also considers such embodiments where the longitudinal axis of the first actuator 12, which is equal to the longitudinal axis of the hollow body 14, does not make the right angle with the longitudinal axis of the second actuator 13. In addition, such designs can be realized when the relative system of mutually perpendicular axes X, Y and Z, with respect to which the above mentioned directions A and B can assume various positions as discussed above, is shifted in plane, but on a plane making an acute angle with the horizontal plane.

FIGS. 10 and 11 show more possible embodiments of the light device in accordance with the invention. In the embodiments of FIGS. 10 and 11, the light system 52 comprises one light source 71 attached to the carrier 72 and a cooler 9 for transfer of heat generated by the light source 71. The light assembly 52 can be selectively moved in the directions A and B to change the light trace produced by the light device on the projection surface. In the embodiment shown in FIG. 10, in the second actuator 13 a through cooling channel 93 is provided for cooling media flow, which the cooling fins 92 of the cooler 9 protrude into. In the embodiment shown in FIG. 11, the second actuator 13, outside the area of the hollow body 14, is made of a full material. The first actuator is then mounted in a selectively slidable manner in the hollow body 14 the second actuator 13 is fitted with.

FIG. 12 shows an embodiment of the light device comprising the static part and the selectively movable light assembly 52. The light assembly 52 includes three rows of light sources 71 fixed to one carrier 72 and to one cooler 9.

The invention is not only restricted to the examples of embodiments of the invention described above, but it also comprises all the modifications and suitable adaptations that fall within the framework of the patent claims attached hereto.

LIST OF REFERENCE MARKS

1—carrying bushing
2—translucent cover
3—inner chamber
4—covering mask
5—optical system
6—holder
7—light unit
8—reflector
9—cooler
10—diaphragm
11—sliding mechanism
12—first actuator
13—second actuator
14—hollow body
15—male thread
16*a*, 16*b*—toothed wheel
17—worm gear
18—recess
19—O-ring
20—anchoring element
21—recess
22—O-ring
25—first drive means
26—second drive means
51—lens
52—light assembly
71—light source
72—carrier
91—cooling elements
92—cooling fins
93—cooling channel
A, B—directions
C—optical axis of the lens
X, Y, Z—coordinate axes of the Cartesian coordinate system

The invention claimed is:

1. A light device, especially a headlight for motor vehicles, comprising a holding bushing (1), covered by a translucent cover (2), and an inner chamber (3) where an optical system (5) for generation of light rays and enabling of controlled selective changes of a light trace on a projection surface, especially carriageway, is mounted, wherein the optical system (5) includes a lens (51) and a light assembly (52) comprising at least one light source (71), a cooler (9) for dissipation of heat generated by the light source (71), and a carrier (72) to carry the light source (71), wherein the lens (51) is arranged in a fixed position with respect to the position of the translucent cover (2), and the position of the light assembly (52) is selectively adjustable in a controlled manner with respect to the position of the lens (51) by selective movement of the light assembly (52) in direction (A) and/or by selective movement in direction (B), wherein the directions (A) and (B) are substantially perpendicular to direction of optical axis (C) of the lens (51), and wherein the light device comprises a first drive means (25) for control of the selective movement of the light assembly (52) in the direction (A) and a second drive means (26) for control of the selective movement of the light assembly (52) in the direction (B).

2. The light device according to claim 1, wherein the direction (A) makes an acute angle with the direction (B).

3. The light device according to claim 1, wherein the direction (A) is substantially perpendicular to the direction (B).

4. The light device according to claim 1, wherein the light assembly (52) comprises a first actuator (12) to which the carrier (72) carrying at least one light source (71) is connected, wherein the first actuator (12) is connected to the first drive means (25) for controlled selective movement of the first actuator (12) in the direction (A), said light assembly further comprising a second actuator (13) connected to the second drive means (26) for controlled selective movement of the second actuator (13) in the direction (B), wherein the first actuator (12) is connected to the second actuator (13) in such a manner that movement of the second actuator (13) in the direction (B) by a certain distance simultaneously causes movement of the first actuator (12) in the direction (B) by the same distance.

5. The light device according to claim 4, wherein the connection of the first actuator (12) to the second actuator (13) is implemented in such a manner that the second actuator (13) is fitted with a supporting part, on which or in which the first actuator (12) is mounted in a selectively slidable manner.

6. The light device according to claim 5, wherein the supporting part is a hollow body (14), the longitudinal axis of which lies in the direction (A), and in which the first actuator (12) is mounted, with the mounting adapted to selectively allow a sliding movement of the first actuator (12) in the direction (A).

7. The light device according to claim 4, wherein the first actuator (12) has a cylindrical part at its end, which cylindrical part is fitted with a male thread (15) for engagement with the first drive means (25), said first drive means comprising a toothed wheel (16*a*) fitted with an inner hole with an inner profile engaging with the male thread (15), and a worm gear having a worm for selective engagement with the teeth of the toothed wheel (16*a*), so that the rotation of the worm is converted to a linear sliding movement of the first actuator (12) in the direction (A).

8. The light device according to claim 4, wherein the second actuator (13) has a cylindrical part at its end, which cylindrical part is fitted with a male thread (15) for engagement with the second drive means (26), said second drive means comprising a toothed wheel (17*a*) fitted with an inner hole with an inner profile engaging with the male thread (15), and a worm gear having a worm for selective engagement with the teeth of the toothed wheel (16*b*), so that the rotation of the worm is converted to a linear sliding movement of the second actuator (13) in the direction (B).

9. The light device according to claim 4, wherein the first actuator (12) includes a cooling channel (93) for cooling media flow where cooling fins (92) of the cooler (9) are mounted.

10. The light device according to claim 1, wherein the cooler (9) includes at least one cooling element (91) and cooling fins (92), the cooling element (91) situated between the carrier (72) of the at least one light source (71) and the cooling fins (92), for dissipation of heat to the cooling fins (92).

11. The light device according to claim 1, wherein the light assembly (52) includes a reflector (8) for reflection of light generated by the light source (71) towards the lens (51).

12. The light device according to claim 1, wherein the light assembly (52) includes a plurality of light sources (71) carried by at least one carrier (72) and arranged on a plane that is substantially perpendicular to the optical axis (C) of the lens (51).

13. The light device according to claim 1, wherein the light device includes at least one diaphragm (10) situated between the lens (51) and the light source (71).

14. The light device according to claim 13, wherein the position of the diaphragm (10) can be, independently of the movement of the light assembly (52), selectively changed in a controlled way.

15. The light device according to claim 13, wherein the diaphragm (10) is part of the light assembly (52), the position of which light assembly (52) can be selectively adjusted in a controlled manner.

* * * * *